United States Patent [19]

Kurihara

[11] Patent Number: 5,073,223

[45] Date of Patent: Dec. 17, 1991

[54] APPARATUS FOR FORMING A PATTERN OF ARTICLES ON A SUBSTRATE

[75] Inventor: Akira Kurihara, Isezaki, Japan

[73] Assignee: Jakob Schlaepfer & Co. AG, Switzerland

[21] Appl. No.: 328,740

[22] Filed: Mar. 23, 1989

Related U.S. Application Data

[63] Continuation of Ser. No. 885,607, Jul. 7, 1986, abandoned.

[30] Foreign Application Priority Data

Nov. 5, 1984 [GB] United Kingdom ..... 8427918
Jan. 18, 1985 [GB] United Kingdom ..... 8501248
Oct. 31, 1985 [EP] European Pat. Off. PCT/EP85/00580

[51] Int. Cl.[5] ..... B44C 3/00; B65C 9/18

[52] U.S. Cl. ..... 156/362; 156/541; 156/552; 156/584; 29/426.3

[58] Field of Search ..... 156/230, 238, 239, 240, 156/241, 277, 289, 540, 541, 356, 360, 361, 344, 584, 234, 542, 291, 552, 362; 414/403, 411, 414, 417; 29/700, 426.3

[56] References Cited

U.S. PATENT DOCUMENTS

| | | | |
|---|---|---|---|
| 3,174,888 | 3/1965 | Morgan | 156/230 |
| 3,190,785 | 6/1985 | Comet | 156/230 |
| 3,657,051 | 4/1972 | McCarthy | 156/230 |
| 3,785,507 | 1/1974 | Wiesler et al. | 29/700 |
| 3,801,408 | 4/1974 | Kuring et al. | 156/552 |
| 3,852,139 | 12/1974 | Jenkins | 156/344 |
| 3,852,140 | 12/1974 | Jenkins | 156/344 |
| 3,856,604 | 12/1974 | Lukkarinen | 156/361 |
| 3,861,986 | 1/1975 | Wochner | 156/542 |
| 3,871,936 | 3/1975 | Boyer et al. | 156/356 |
| 4,059,470 | 11/1977 | Primavesi et al. | 156/238 |
| 4,094,438 | 6/1978 | Neubauer | 156/250 |
| 4,101,362 | 7/1978 | Baker et al. | 156/238 |
| 4,217,164 | 8/1980 | LaMers | 156/541 |
| 4,240,862 | 12/1980 | Ishiyama | 156/361 |
| 4,263,766 | 4/1981 | Baker et al. | 156/361 |
| 4,369,082 | 1/1983 | Kerwin | 158/238 |
| 4,383,880 | 5/1983 | Geurtsen | 156/361 |
| 4,393,116 | 7/1983 | Taylor | 156/230 |
| 4,451,318 | 5/1984 | Off et al. | 156/361 |
| 4,494,902 | 1/1985 | Kuppeus et al. | 156/541 |
| 4,522,671 | 6/1985 | Grünwald et al. | 158/240 |
| 4,612,078 | 9/1986 | Karp | 156/361 |
| 4,617,080 | 10/1986 | Kobayashi et al. | 156/542 |
| 4,668,314 | 5/1987 | Endoh | 156/291 |
| 4,789,419 | 12/1988 | Hermann | 156/149 |

FOREIGN PATENT DOCUMENTS

| | | |
|---|---|---|
| 0119669A1 | 9/1984 | European Pat. Off. . |
| 0199810B1 | 11/1986 | European Pat. Off. . |
| 2644462 | 8/1977 | Fed. Rep. of Germany . |
| 2953314 | 10/1980 | Fed. Rep. of Germany . |
| 8300349 | 2/1983 | PCT Int'l Appl. . |

*Primary Examiner*—Michael W. Ball
*Assistant Examiner*—Jeff H. Aftergut
*Attorney, Agent, or Firm*—Ostrolenk, Faber, Gerb & Soffen

[57] ABSTRACT

The present invention relates to a method and apparatus for mounting a decorative article on a receptor sheet. Each article has an adhesive layer on one surface for bonding it to a sheet to which the article is to be applied. Initially, the article is to be mounted on a tape which is supplied to an article transfer station. Then, the tape is moved to the article transfer station, at which the articles are sequentially transferred to a substrate.

17 Claims, 14 Drawing Sheets

PIA
70
71
72
73
74
+
D.C.
−
75
77
76
53
55
41
42
57
66
33
34
26
28
29

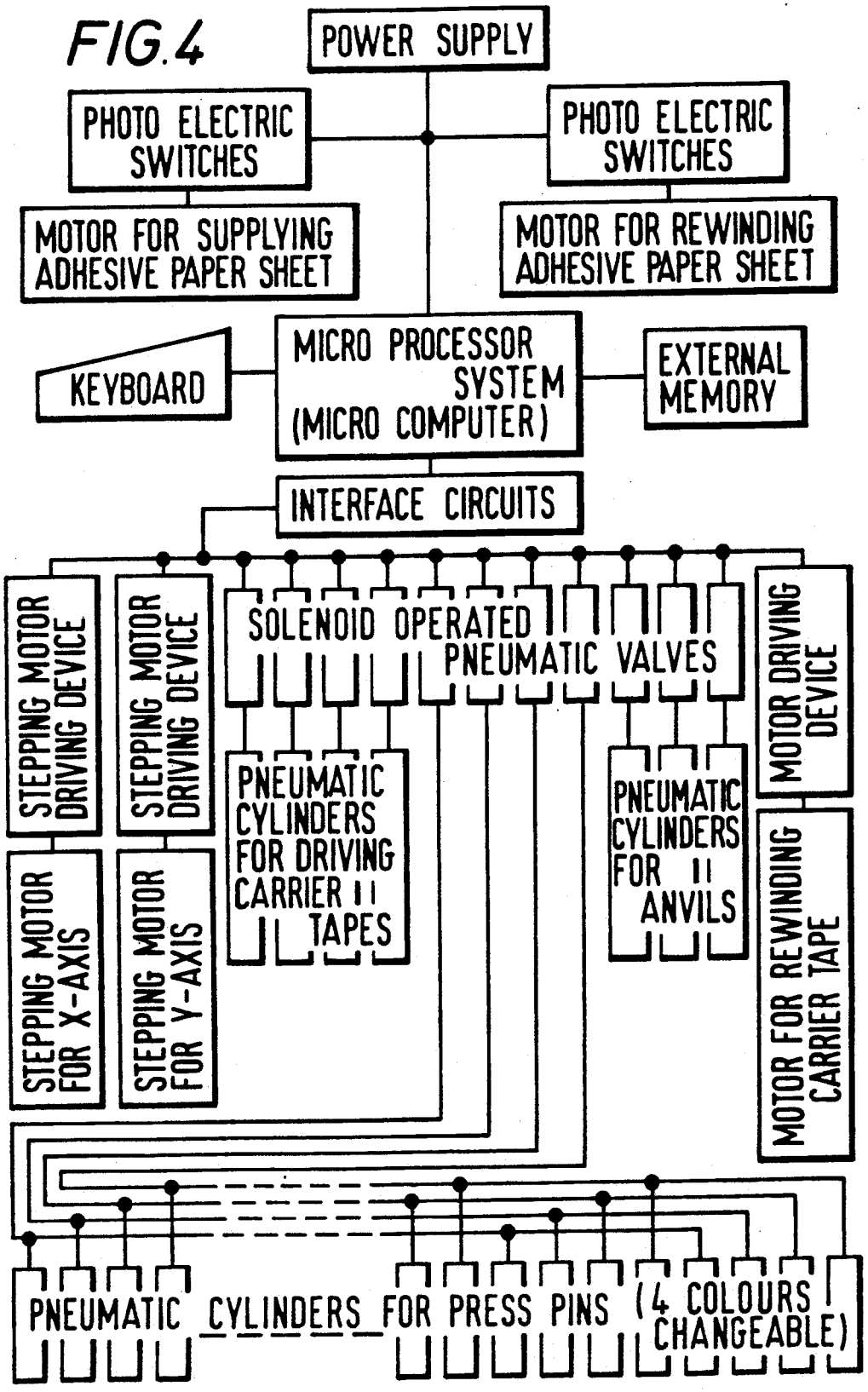
FIG.4
POWER SUPPLY
PHOTO ELECTRIC SWITCHES
PHOTO ELECTRIC SWITCHES
MOTOR FOR SUPPLYING ADHESIVE PAPER SHEET
MOTOR FOR REWINDING ADHESIVE PAPER SHEET
KEYBOARD
MICRO PROCESSOR SYSTEM (MICRO COMPUTER)
EXTERNAL MEMORY
INTERFACE CIRCUITS
STEPPING MOTOR DRIVING DEVICE
STEPPING MOTOR DRIVING DEVICE
SOLENOID OPERATED PNEUMATIC VALVES
MOTOR DRIVING DEVICE
PNEUMATIC CYLINDERS FOR DRIVING CARRIER " TAPES
PNEUMATIC CYLINDERS FOR " ANVILS
STEPPING MOTOR FOR X-AXIS
STEPPING MOTOR FOR Y-AXIS
MOTOR FOR REWINDING CARRIER TAPE
PNEUMATIC CYLINDERS FOR PRESS PINS (4 COLOURS CHANGEABLE)

APPARATUS FOR FORMING A PATTERN OF ARTICLES ON A SUBSTRATE

This is a continuation of application Ser. No. 06/885,607 filed on July 7, 1986, now abandoned.

BACKGROUND OF THE INVENTION

The present invention relates to the decoration of sheet materials and includes inter alia the production of transfers. In particular, it relates to the production of transfers formed by comprising a pattern of similar or different transferable items on a suitable carrier sheet which may be used in said decoration.

Transfers comprising a carrier sheet for the article or articles to be transferred, and one or more articles carried on the carrier sheet, are well known. Such transfers are particularly well known in the textile industry where the carrier sheet has a contact adhesive on its surface which serves to retain temporarily the articles to be transferred, while the articles each have a layer of an adhesive, typically a heat-sensitive adhesive, whereby on laying the transfer on a textile material to which the transfer is to be applied, the application of heat and pressure causes the heat sensitive adhesive on each of the articles to be transferred, to be activated to flow under the applied pressure into the adjacent surface of the textile material and to develop a bond to the material, which is greater than the bond between the carrier sheet and the article to be transferred. On release of the heat and the pressure, therefore, the carrier sheet can be peeled back from the transferred articles leaving the transferred articles in position.

This technique is generally well known and has been applied to many different kinds of articles, for example, colored foil, beads, rhinestones and embroidered articles, but the formation of the transfers comprising a number of individual transferable items has hitherto been a costly and time consuming business and, in many cases, requires individual preparation virtually by hand.

There is a need within the textile industry to provide complex designs and patterns of similar and/or different items on a sheet material in a reproducible manner. This is particularly important in the application of such patterns to pre-cut textile fabrics where it is important to ensure the registration between the design on the one hand and the cut textile fabric on the other. In order to achieve this it is necessary that the patterns themselves be as nearly identical to one another as possible. Furthermore, when transfers are produced, it is essential that the patterns provided should be repeated at precise intervals on a carrier sheet to enable accurate registration or indexing of the pattern with the precut sheet or article by automatic handling equipment during application of the transfer. In particular, there is a need to provide a pattern in a reproducible form at a low price.

According to one aspect of the present invention, there is provided a method of making a transfer by mounting transferable articles on an intermediate sheet material, each article having an adhesive layer on one surface thereof for the purpose of effecting a bond to a final sheet material to which it is subsequently to be applied, which method comprises, 1. mounting each said article on a longitudinal tape constituting intermediate support for each article,
2. each article as mounted on said tape being oriented so that its adhesive layer is disposed in the same direction relative to the tape, 3. mounting said tape for supply to an article transfer station at which one or more articles may be applied to a sheet substrate, and
4. thereafter causing or allowing the transfer of said articles at said transfer station from said tape either directly or indirectly to a substrate with the adhesive layer of the article juxtaposed with the receptor sheet substrate; and wherein the application of heat and pressure causes or allows said articles to be attached to said substrate in a predetermined pattern.

The invention also includes a transfer tape comprising a longitudinal self-supporting perforated tape having an adhesive layer on one side thereof and a plurality of transferable articles adhering to said adhesive layer in a longitudinal array, each article being in register with a perforation in the tape.

The invention further includes apparatus for forming a pattern of articles on a substrate, which comprises means for advancing a longitudinal length of substrate material along a substrate path, a transfer station comprising a plurality of transfer heads extending transversely of said path, each transfer head being adapted to transfer articles to said substrate, magazine means associated with each said transfer head for the supply of said articles to said substrate, and control means for controlling relative movement between the substrate and the transfer heads, wherein the magazine means includes a longitudinal tape carrying a plurality of said articles thereon for transfer to said substrate, and means for advancing said tape to said respective transfer head at which an article or groups of articles are presented for transfer.

The invention also includes an intermediate carrier sheet having a layer of adhesive on one surface, where said layer carries a plurality of articles arranged in a regular pattern thereof, each article having a layer of heat sensitive adhesive on one surface thereof and oriented so that said layer is remote from the intermediate carrier sheet material.

In one embodiment of the invention, the substrate is an intermediate carrier sheet having a layer of tack adhesive thereon, said articles being transferred thereto at said article transfer station, each article being oriented with respect to the carrier sheet so that its adhesive layer is remote from the carrier sheet, and thereafter applying the intermediate carrier sheet to a receptor sheet to be decorated with the adhesive layer of the articles juxtaposed said receptor sheet; and wherein the application of heat and pressure causes adhesion of said articles to the receptor sheet thereby permitting removal of the carrier sheet to leave the pattern of articles applied to the receptor sheet. The articles may be disposed on said tape with the adhesive layer in contact with the adhesive layer on the tape surface.

In a further embodiment of the invention, the substrate may be the receptor sheet to be decorated. The transfer station may include heat and pressure means to provide sufficient adhesion between the adhesion layer on said article and said receptor sheet to retain said articles to form a pattern of articles thereon. The decorated receptor sheet may be subjected to the application of heat and pressure to effect more permanent bonding of the article to the receptor sheet material.

The tape may be a perforated tape and the article may be contacted therewith such that on contacting the adhesive layer of the tape for temporary adhesion thereto, each article covers a perforation in the tape. The article may be contacted with a perforated tape such that at regular intervals, a perforation is uncovered to allow said uncovered perforations to engage a sprocket wheel for transport of the tape. In a particular embodiment of the invention, alternate perforations of the tape are covered by articles.

Said transfer station may include one or more transfer heads, each head being adapted to transfer articles from said tape to said substrate, said heads being disposed transversely with respect to the longitudinal axis of said substrate material and arranged for transverse movement with respect thereto, whereby integer movement of the substrate and transverse movement of the heads with respect thereto from its application of a pattern of articles to a substrate. The tape carrying said articles may be wound on a spool which may be mounted in juxtaposition to said transfer head for the sequential supply of articles thereto.

The apparatus of the invention may include a transfer station comprising tape guide means for guiding said tape, a reciprocating member adapted to engage said tape, means to align an article on said tape with said reciprocating member whereby operation of the reciprocating member is caused to engage the tape and/or article thereon, to urge said article into adhesive contact with said substrate. Where the tape is perforated, sprocket means may be adapted to engage perforations in the tape to advance the tape to bring a perforation covered by an article into registration with the reciprocating member whereby on operation of said reciprocating member, said member enters the perforation and contacts the article to urge the article into adhesive contact with the substrate and simultaneously releasing the article from said tape.

The transfer station may include anvil means juxtaposed the substrate sheet and aligned with said reciprocating member, the arrangement being such that operation of the reciprocating member brings said article into adhesive engagement with the substrate by pressure against the anvil means. The anvil means may be movable between a pressure position and a free position so that in the pressure position it supports the substrate sheet to allow the reciprocating member to press the adhesive layer of the substrate against the back pressure of said anvil member. Where the substrate is the receptor sheet material to be decorated, the anvil member may be heated. In this latter case, the articles may be disposed on the tape with the adhesive layer of the articles disposed on the side of each article remote from said tape for contact with the receptor sheet.

The control means may move the substrate sheet material forwards, in reverse or laterally with respect to the transfer station and/or provide integer motion or stop/start operation. The control means may further act to control the movement of one or more of the transfer heads and/or the movement of the substate material, thus allowing the formation of, for example, circles, curves and lateral lines.

In addition to the composition of patterns for direct or transfer application, the apparatus of the invention allows for the manufacture of patterns in the form of strips or individual motifs which may be cut subsequently and sold as strips or as individual motifs.

The articles may be applied directly to cut pieces. In this case the precut pieces of substrate material may be carried by a continuous mounting or backing sheet or on an endless carrier belt.

The present invention further includes a method of mounting a transferable article on a sheet material in which each article has an adhesive layer on one surface thereof for the purpose of effecting a bond with a sheet material to which it is subsequently to be applied, which method comprises sorting said articles to orient each article so that the adhesive layer of each article is disposed in the same direction, feeding the articles sequentially to a mounting station, providing a continuous tape having an adhesive layer on one side thereof at said mounting station, contacting the article with the adhesive layer on the tape so that the article is carried on said tape and may subsequently be detached therefrom while retaining the adhesive layer on the article substantially intact. In one aspect of the invention the adhesive layer on the article is in contact with the adhesive layer on the tape.

The articles may be supplied to the transfer head in a line and a reciprocating member may engage an article and push it into contact with the tack adhesive layer on said tape. The tape may be carried by at least one sprocket to permit accurate registration of a perforation and an article.

In an alternative embodiment, the mounting station may comprise a roller having a plurality of circumferentially spaced recesses, each adapted to accommodate an article in a particular orientation, a reciprocatable locating member adapted to lift an article from said supply into a recess, and a sprocket wheel which engages a perforated tape, the sprocket engaging not more than alternate perforations, whereby the sprocket tines engage with the periphery of the roller intermediate the recesses so that on rotation, an article in a recess is brought into engagement with the adhesive layer of the tape in register with a non-engaging perforation whereby the article adheres to said adhesive layer and is transported with said perforated tape.

The adhesive layer on the article is preferably a heat sensitive adhesive.

The invention further includes a method of providing a transferable pattern of articles which method comprises passing a transfer pattern receptor sheet progressively past a transfer station, said sheet having an adhesive layer on one side thereof, arranging a plurality of transfer heads at said transfer station in line across said sheet, providing a magazine of an article carrying transfer tape associated with each transfer head, causing the receptor sheet to move transversely of the transfer station and causing or allowing transfer of articles to take place from said tapes to said receptor sheet in accordance with a regular pattern across said receptor sheet.

In this way the apparatus of the present invention permits the production of a pattern and/or design on a carrier sheet in a reproducible manner. The machine is ideally suited to automated methods and digital control means may be provided for control of the pattern within the machine.

An advantage of the present invention is that it permits the continuous production of patterns on endless sheet materials. This means that not only can a lengthy longitudinal sheet such as a roll of fabric be treated directly, but cut pieces of a sheet material to be decorated may be positioned on, for example, a conveyor belt and then decorated in accordance with the present invention. This is of very considerable advantage in the textile industry and particularly the fashion industry, since it will be appreciated by the man skilled in the art that it is extremely difficult to cut material after patterns of, for example, rhinestones, have been applied thereto. The same applies to a lesser extent to cut parts which have subsequently to be sewn or stitched to other components or materials.

The present invention provides either direct transfer of a carefully controlled pattern to an endless sheet material or the formation of an intermediate transfer or carrier sheet which may then be used subsequently to transfer the pattern of decorative articles to a final decorated fabric product. In this connection whichever transfer system is employed whether direct to the final finished fabric product or by way of an intermediate carrier sheet, the patterns produced can be built up progressively, i.e. a first series of decorative articles may be deposited or applied in an initial pattern and then the final substrate material or intermediate carrier sheet may then be passed again through the machine in accordance with the invention in order to apply second pattern of similar or different articles, thus building up a complex pattern.

The patterns, partial patterns and so on may be controlled via the control means using properly prepared software which can be translated into a pattern forming operation through punched cards, magnetic cards and/or magnetic tapes.

In a further embodiment of the present invention where an intermediate transfer is produced, the intermediate carrier sheet will be produced by the machine having a plurality of articles disposed on a carrier sheet, each article having a layer of a heat sensitive adhesive on the side thereof away from the surface of the transfer sheet material itself.

It then remains to lay the carrier sheet carrying the decorative articles on the substrate such that the heat sensitive layer on each article is in contact with the substrate to which the article is ultimately to be transferred.

In one aspect of the invention, the carrier sheet and the substrate are passed between the jaws of a heated anvil press which applies heat and pressure, thereby activating the heat sensitive adhesive and causing the heat sensitive adhesive to adhere to the substrate, so that after passing between the jaws of said anvil press, separation of the carrier sheet from the substrate results in the weaker bond between the articles and the contact adhesive on the carrier sheet surface breaking in view of the superior adhesion between the article and the substrate by means of the heat sensitive adhesive, thereby leaving the articles disposed in the predetermined transfer pattern on the substrate itself.

In a further embodiment of the present invention it has been found that by vibrating one or the other of the jaws of the anvil press, improved adhesion is obtained. In particular, vibration of the heated jaws of the order of 50 to 150 cycles per minute, while applying a pressure of 0.5 to 3 kilograms per square centimeter for a sheet speed of 3 to 10 meters per minute, has been found to produce good results.

In accordance with the invention it will be appreciated that the advantages of mounting decorations on an intermediate transfer sheet instead of applying direct to the fabric are inter alia that the transfer so produced can be stored for subsequent transfer on a heat transfer device of the type described above. Furthermore, it is possible to have larger production runs of the patterns per se and store these against need for use in connection with individual piece goods.

The production of transfer media tends to avoid multiple changes of fabric and/or decorative articles and programs on the machine. This allows a longer production run in respect of each particular pattern and each particular set of decorative articles.

Commercially, orders for specific patterns can be met more rapidly since patterns and transfers can be produced for stock. Furthermore, the pattern forming machine forming the subject of the present invention can be caused to operate at a much greater rate than will be the case if decorative articles were being transferred direct to the final substrate, since in the latter case it is necessary for the machine to stop sufficiently long to allow for activation of the heat sensitive adhesive to occur before proceeding to the next pattern-forming step.

In spite of the foregoing, however, there are cases where significant advantages follow from the operation of a direct transfer system. In particular direct transfer is suitable for fabrics with delicate surfaces which would suffer if brought into overall contact with the sticky contact adhesive surface of a carrier sheet, particularly if pressed and heated to effect the transfer and then subsequently torn apart and separated from the then-redundant carrier sheet after transfer. This problem can be overcome only by the direct transfer of articles from the tape to the fabric.

It will be appreciated that where direct transfer of articles is effected from the tape to the fabric substrate, the orientation of the articles on the adhesive layer of the tape will be different than if the articles are to be applied, for example, to an intermediate carrier in a transfer type operation. In the case of direct transfer, therefore, the decorative articles will be mounted on the tape with the layer of heat sensitive adhesive exposed for subsequent transfer directly to the final receptor using the apparatus in accordance with the present invention. In the case of indirect transfer, i.e. initial transfer onto a receptor sheet, it will be appreciated that the articles will be mounted on the tape with the layer of heat sensitive adhesive in juxtaposition with the tack adhesive layer of the tape so that on transfer to an intermediate carrier sheet, the layer of heat sensitive adhesive will then be exposed. In the formation of the tapes carrying the decorative articles it will be appreciated that the rolling of the tapes into spools will provide for additional fixing of the articles into the adhesive layer of the tape itself.

Following is a description by way of example only and with reference to the accompanying drawings of methods of carrying the invention into effect.

BRIEF DESCRIPTION OF THE DRAWINGS

In the drawings:

FIG. 4 is a block diagram of the control circuitry for use in the machine of FIG. 1.

DETAILED DESCRIPTION

Figure 1:
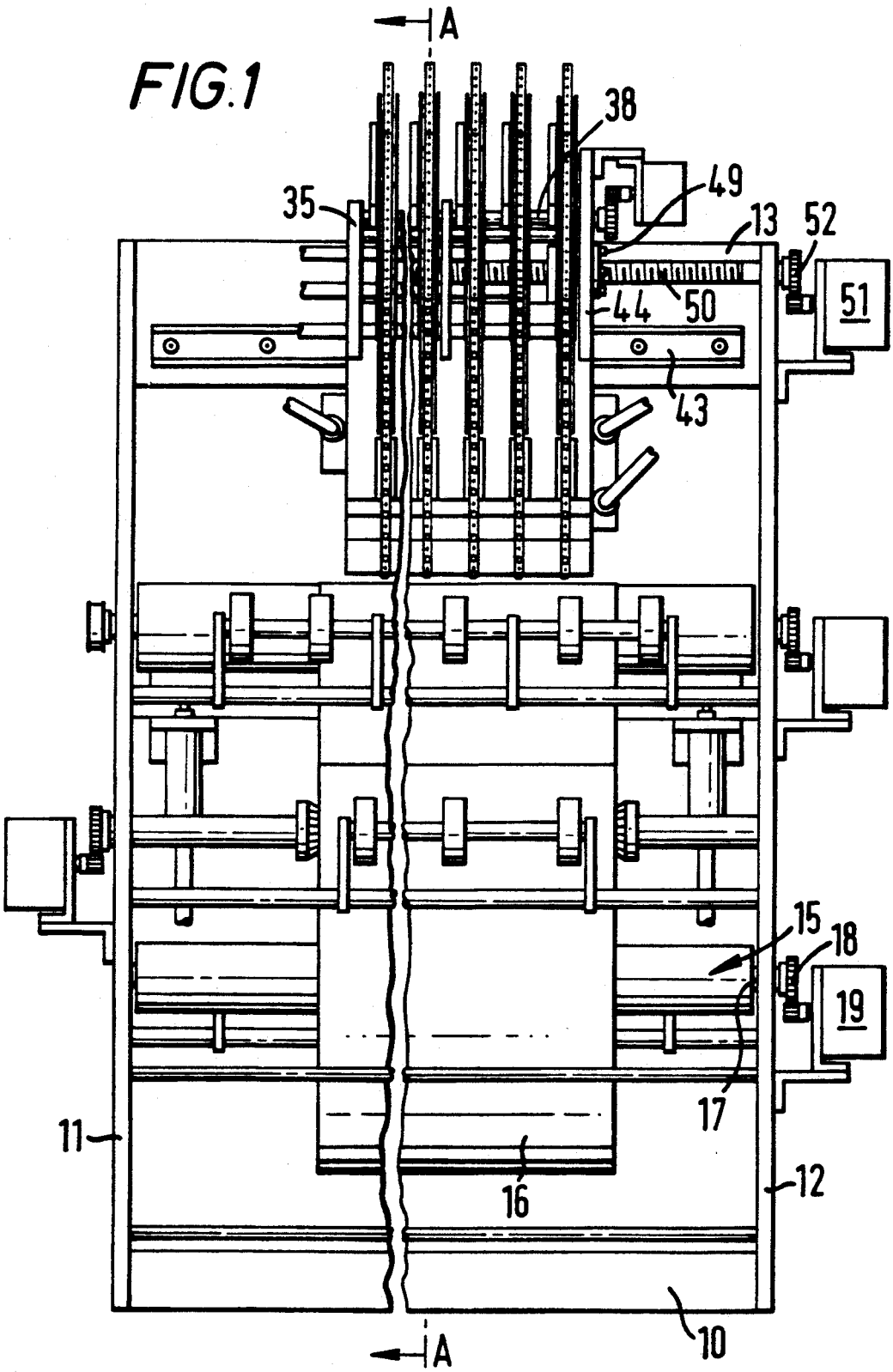
FIG. 1 is an end view of a machine for providing a regular repeatable pattern on a sheet of suitable carrier material.

The machine illustrated in FIG. 1 comprises a base 10 having first and second erect side members 11, and 12 respectively, each of which side members carry a cross head beam 13. The frame thus formed is provided with an intermediate cross piece 14 (see FIG. 2).

The frame supports via first and second side members 11 and 12 a roller 15 adapted to carry a roll 24 of carrier sheet materials. The roller 15 is carried by means of an axle 17 journalled for rotation in each of first and second side frame members 11 and 12 respectively and carrying at its outer end gear means 18 which is operatively connected to drive motor 19 for driving of the roller 15 and its corresponding roll 24 of carrier sheet material. A corresponding supply roller 20 is provided rearwardly of roller 15 (see FIG. 2) and corresponding drive means (not shown) is also provided.

Intermediate the rolls 24 and 20 and upwardly of the plane thereof is provided a first guide roller 21 and a second guide roller 22, which are adapted to receive a continuous supply of carrier sheet 23 from roll 16 which passes about guide roller 21 and thence to roller 22 and passes along a carrier sheet path to take-up roll 24 on roller 15. Each of rollers 21 and 22 is provided with a idler roll 25 which is biased into contact with the carrier sheet 23 passing about the surface of rolls 21 and 22 respectively.

Figure 2:
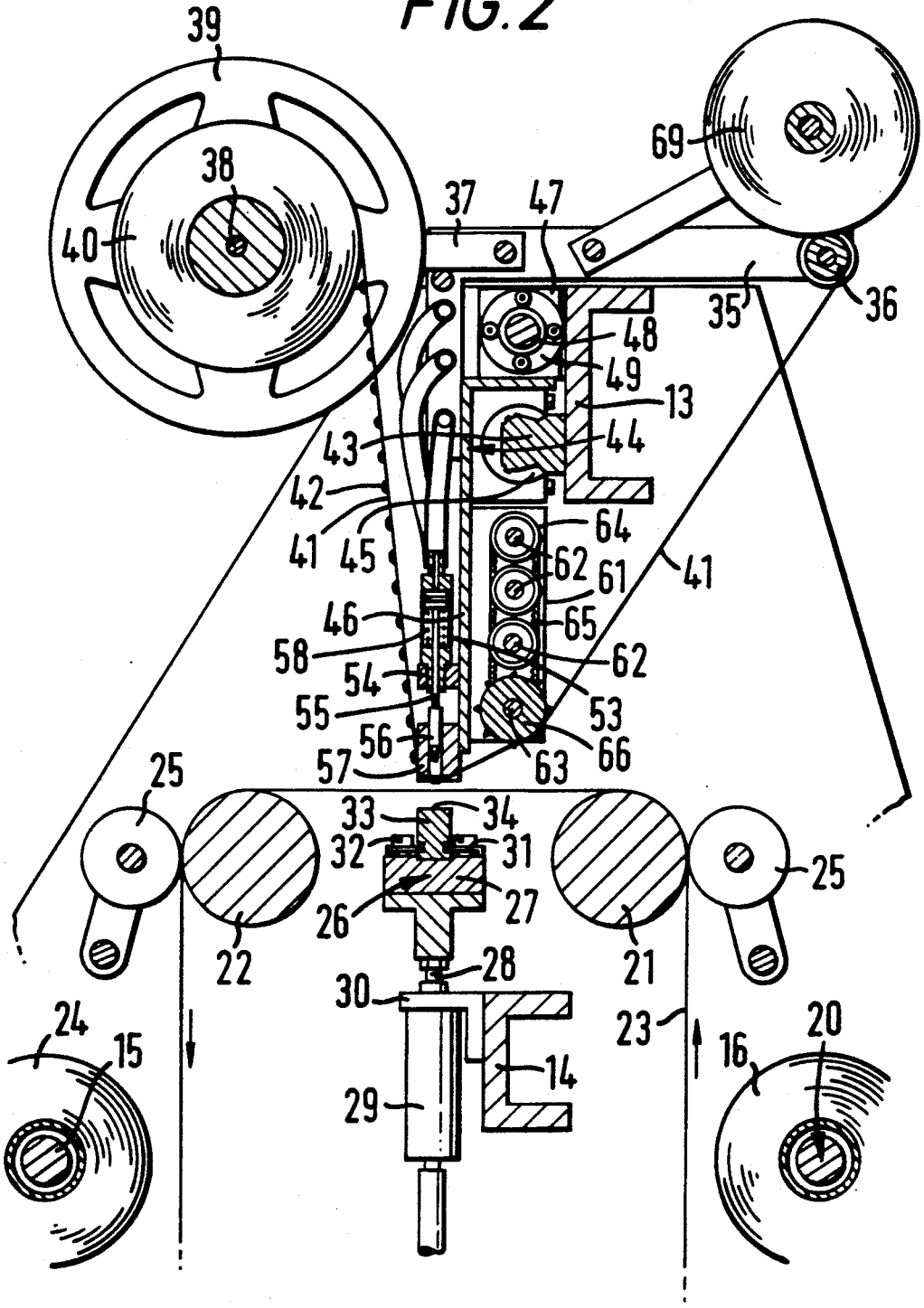
FIG. 2 is a section on the line A—A of FIG. 1.

Between rolls 21 and 22 there is provided an anvil assembly 26 comprising a central body member 27 fixedly secured to the upper end of a piston rod 28 of pneumatic cylinder 29 which latter is secured to intermediate cross piece 14 by means of bracket 30 (see FIG. 2).

The anvil body member 27 is provided at its upper end with an annulus 31 secured to the upper surface of body 27 by means of set screws 32, the body 27 including an upwardly extending anvil element 33 having a substantially planar upper surface 34 constituting an anvil surface.

Crosshead beam 13 is provided with a transverse bearing rail 43 which has mounted thereon a longitudinally extending carriage indicated generally at 44 having a contoured rail engaging member 45 capable of sliding movement along rail 43. The carriage 44 includes a depending support member 46 surmounted by a carriage block 47 having a central bore 48 with an annular threaded nut member 49 fixed thereto and adapted to accommodate threaded driven screw 50 driven by pneumatic motor 51 via gear train 52, the arrangement being such that operation of the motor 51 serves to rotate mounted screw 50 which causes nut member 49 to move transversely of the apparatus and to drive carriage 44 transversely of the apparatus along rail 43 with respect to side members 11 and 12 respectively.

Carriage block 47 carries at its upper end a pair of spaced rearward arms 35 which together carry for rotation relative thereto a guide roller or rollers 36. Arms 35 carry at their forward end a forwardly extending bracket 37 carrying at its extremity a transverse axle 38 which is adapted to carry a plurality of laterally spaced tape reels 39 carrying a roll 40 of perforated tape 41 carrying transferable articles 42 sequentially loaded thereon in the manner hereinafter described.

Figure 9:
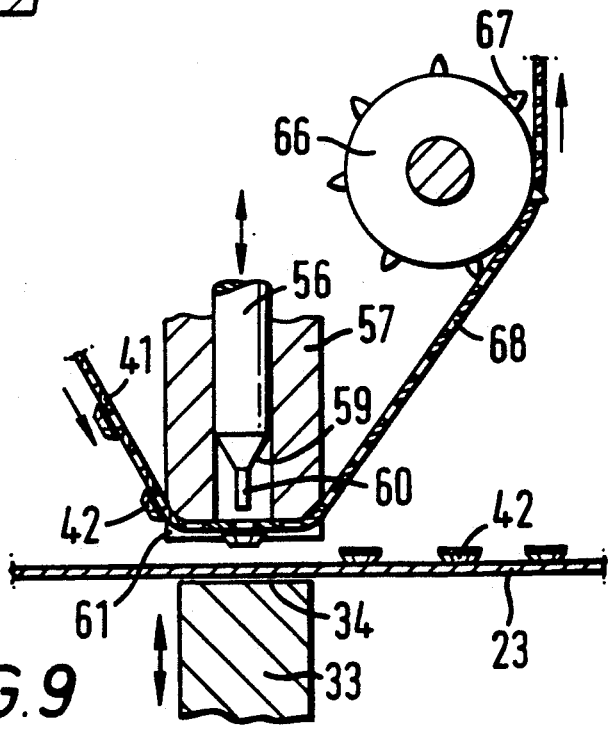
FIG. 9 is a further detail of FIG. 5.

The support member 46 carries a plurality of laterally spaced pneumatic cylinders 53 one each of which is associated with a tape reel 39, the cylinders 53 each being secured to support member 46 by means of mounting block 54. Each cylinder 53 has associated piston rod 55 extending downwardly thereof and secured at its lower end to a cylindrical element 56 carried in guide block 57 for vertical sliding movement therein in response to movement of piston rod 55 under the action of pneumatic cylinder 53. In its rest position the piston rod 55 is biased upwardly by means of compression spring 58. The cylindrical element 56 is provided towards its lower end with a frustoconical intermediate portion 59 and terminates at its lower end in a pin 60 (see FIG. 9). The lower extremities 61 of guide block 57 are contoured to constitute a guide surface for tape 41, the arrangement being such that the tape is guided in a path across the open cylindrical end of the bore in block 57 accommodating cylindrical element 56.

The rearward surface of support member 46 carries a mounting block 61*a* supporting three horizontally disposed vertically spaced shafts 62 and a lower shaft 63. Each of shafts 62 carries a synchronous wheel 64 each of which is toothed on its outer surface and adapted to engage with a toothed synchronous belt 65, the arrangement being such that one or more of shafts 62 may be driven to provide synchronous drive of shaft 63. Shaft 63 carries a sprocket wheel 66 juxtaposed and aligned with guide block 57. Sprocket wheel 66 has a plurality of sprocket tines 67 circumferentially spaced about the periphery of wheel 66 and arranged to engage every other perforation 68 in perforated tape 41.

The path of tape 41 extends from sprocket wheel 66 upwardly and rearwardly to engage guide roller 36 and onto tape-up roll or spool 69.

Figure 3:
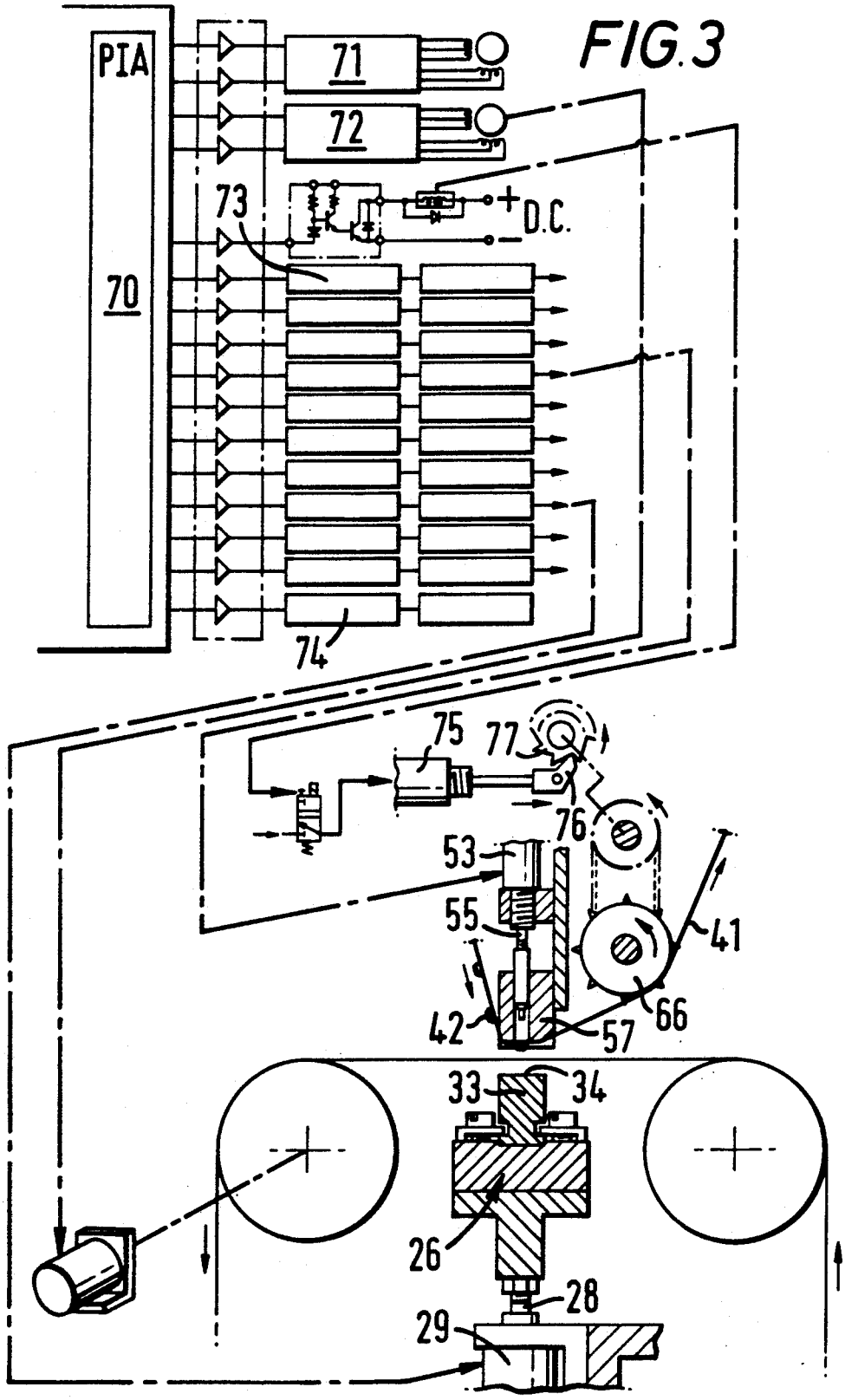
FIG. 3 is a diagrammatic representation of the control mechanism for the machine of FIG. 1.
Figure 5:
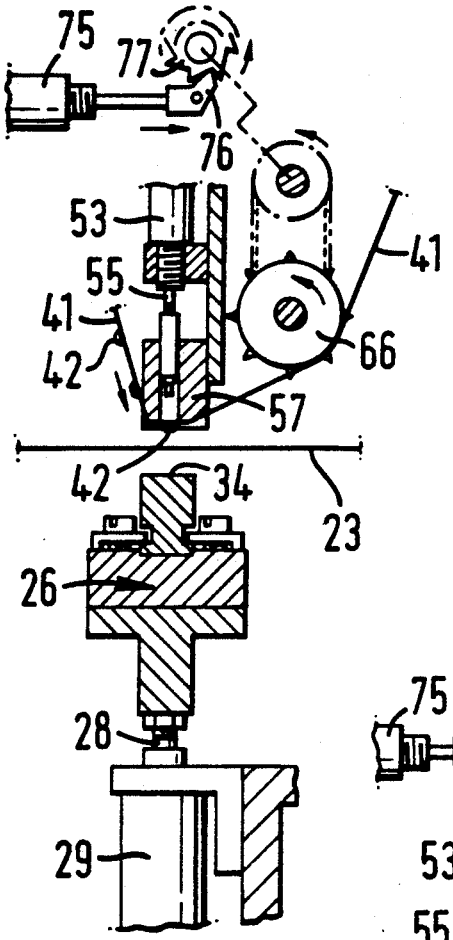
FIGS. 5, 6, 7 and 8 are details of the sequence of the application of the articles to a carrier sheet using the machine of FIG. 1.
Figure 6:
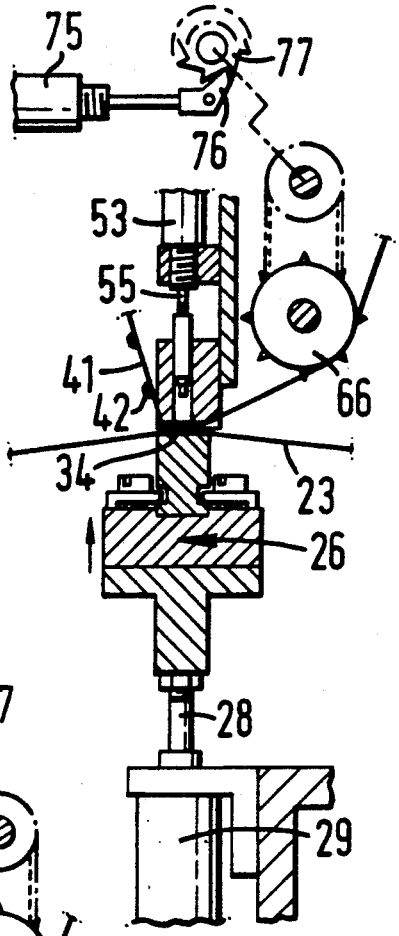
Figure 7:
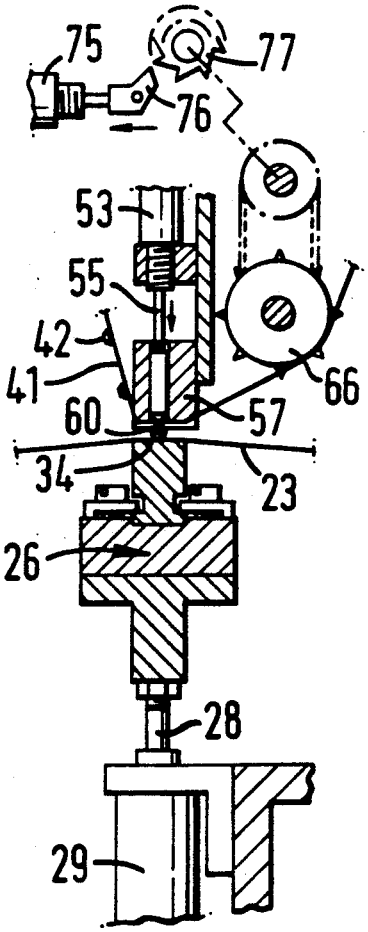

FIG. 3 discloses the control mechanism starting with a peripheral interface adaptor 70 which is connected with stepping motor driving devices 71 and 72 for the "X-axis" and "Y-axis" control motors 51 and 19 respectively.

Peripheral interface adaptor 70 also drives and controls the driving circuits for the respective solenoid for each of the solenoid-operated pneumatic valves connected to the various pneumatic cylinders 53, which are adapted to drive cylindrical elements 56, and associated pins 60, and also to drive the drive cylinder 29, for each of the anvil assemblies 26. The peripheral interface adaptor 70 also communicates with motor driving device 74 adapted to cooperate with the motor for winding and rewinding the carrier tape (not shown).

FIG. 4 is a block schematic diagram showing the inter-relationship between the various components for a multicolour pattern arrangement.

The operation of the mechanism for effecting the transfer of a decorative article from perforated tape 41 to carrier sheet 23 is more clearly shown in FIGS. 5, 6, 7, and 8 which together illustrate the sequence of operations. The sprocket wheel 66 is driven by means of a pneumatic cylinder 75 with a ratchet pawl 76 at the end of the piston rod thereof adapted to engage with ratchet detents on a ratchet wheel 77, the arrangement being such that reciprocation of the pawl results in advance of the ratchet wheel by one detent and corresponding rotation of the sprocket wheel to bring the next transferable article 42 into register with the bore in guide block 57.

Figure 8:
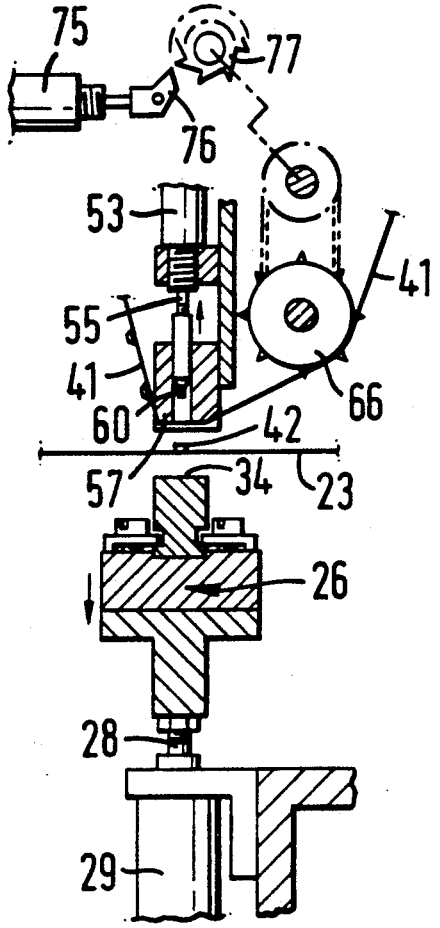

The pneumatic drive in cylinder 29 is then activated to advance piston 28 upwardly to bring the anvil surface 34 in contact with the underside of carrier sheet 23 and to urge the same into contact with the exposed surface 78 of transferable article 42 (see FIG. 10) to bring the adhesive layer 79 into contact therewith. On completion of this operation the pneumatic cylinder 53 is activated to drive piston rod 55 downwardly thus causing pin 60 to enter the aligned perforation within the tape and to engage the adhesive surface 80 of article 42 so that continued downward movement of the pin 60 causes the pin to pass through the perforation and disengage article 42 therefrom and urge it into adhesive contact with the adhesive layer 79 of carrier sheet 23. On completion of this operation the pneumatic pressure supplied to each of cylinders 29 and 53 is relaxed, resulting in withdrawal of the anvil assembly 26 to its datum position and withdrawal of the pin and associated assembly 60 also to its datum position, while leaving the article 42 adhering to the adhesive surface 79 of the carrier sheet 23 as shown in FIG. 8.

At this stage the stepping motors 51 and 19 for driving the carriage 44 on the X-axis, and for driving the carrier sheet 23 on the Y-axis, or either of these, advances by the next increment and the sequence is repeated.

It will be appreciated that the stepping motor driving devices 71 and 72 and the control motors 51 and 19, for the X-axis and Y-axis control, respectively, may be arranged in various ways. For example, in the case of the Y-axis, the motor 19 may be arranged to move the sheet forwards or backwards to provide for the formation of circles, oblongs, squares and the like and for the formation of meandering lines. The movement in the Y-axis may be nil to allow movement of the cylinders 53 in the X-axis to permit the formation of lines of decorations, which may be of the same or different colours, transverse to the Y axis.

It will be appreciated that with a plurality of magazines (tape reels) 39 spaced across the machine as shown in FIG. 1, it is possible to present sequences of articles, and that by approximately controlling the individual transfer mechanisms, only some of the number of transferable articles juxtaposed with the transfer head assembly may be transferred to the carrier sheet.

Alternatively, the pattern may be varied by, for example, having a different fill arrangement for transferable articles 42 on tape 41, wherein the control can be readily effected by varying the instructions provided to the controlling microprocessor as shown in the block digram in FIG. 4.

Furthermore, lateral movement of the transfer assembly heads may be effected by relative operation of motor, 51 thereby providing lateral movement of the transfer assemblies relative to the carrier sheet path, thus providing greater control over the number and nature of patterns that may be provided.

Figure 10:
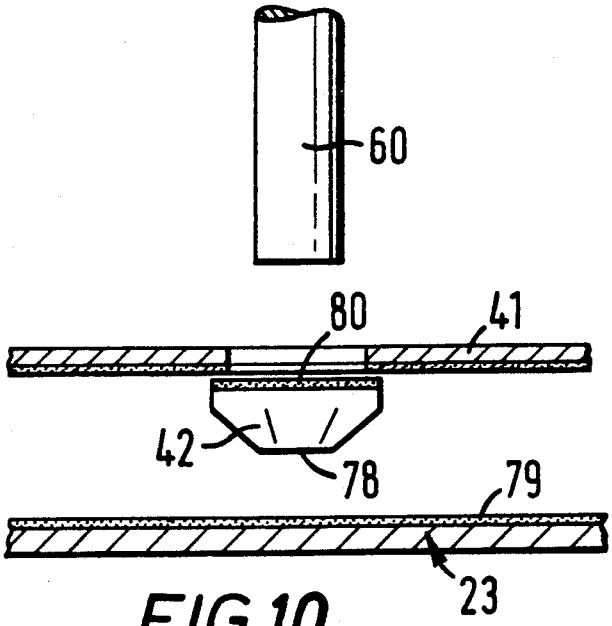
FIG. 10 is a detail of the tape and carrier sheet for use with the machine of FIG. 1.

In a typical embodiment of the present invention the transferable article may be a small rhinestone as shown in FIG. 10 comprising a rhinestone element 42 having a shaped surface and a larger planar base surface which base surface is provided with a coating of heat sensitive adhesive 80. The carrier tape 41 should be a tape which is of a non yielding construction without stretch or shrinkage in operation and storage. Typically, the carrier tape 41 may be a tape such as that sold by the Minnesota Mining & Manufacturing Company and referred to as "3M's paper", which comprises a tape having a coating of adhesive on one side thereof. The transferable article 42 is arranged on said tape so as to be symmetrically disposed about the axis of a perforation therein as shown in FIG. 10 from which it will be noted that the perforation is smaller than the decorative articles to be applied.

The adhesive layer 80 on the base of the transferable article 42 contacts the adhesive layer on the tape, so that on transfer as the pin 60 moves into and through the perforation in the tape, it abuts the layer of adhesive 80 on transferable article 42 and continued movement of the pin 60 breaks the adhesion between the adhesive layer 80 and the adhesive layer of the tape and urges the exposed surface 78 of the transferable article 42 into adhesive contact with the adhesive layer 79 on the side of the carrier sheet 23. It will be appreciated that the carrier sheet should be of consistent properties, i.e. the adhesive layer should not show any significant derioration on storage and the dimensional properties should be stable with ageing. Typically, the carrier sheet 23 may be a sheet of material carrying a layer of adhesive of the type manufactured by the Minnosota Mining & Manufacturing Company.

In this way, a transferable pattern of individual transferable articles may be built up on these sheets and the patterns are entirely reproducible using the machine described above.

Figure 11:
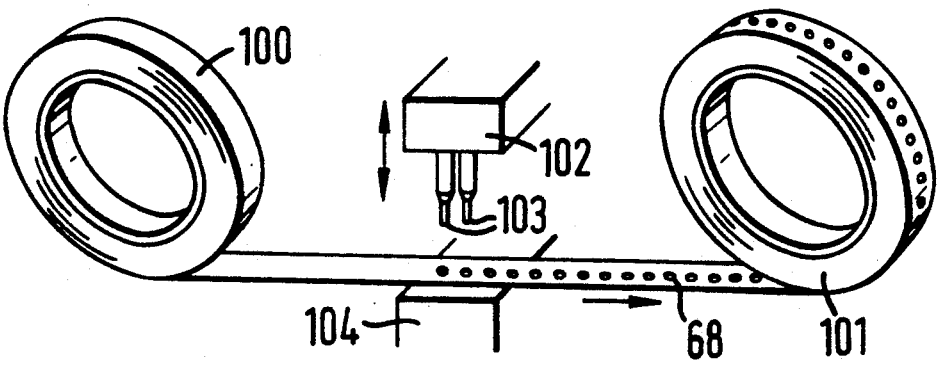
FIG. 11 is a diagrammatic representation of the production of the perforated tape used in the machine of FIG. 1.
Figure 12:
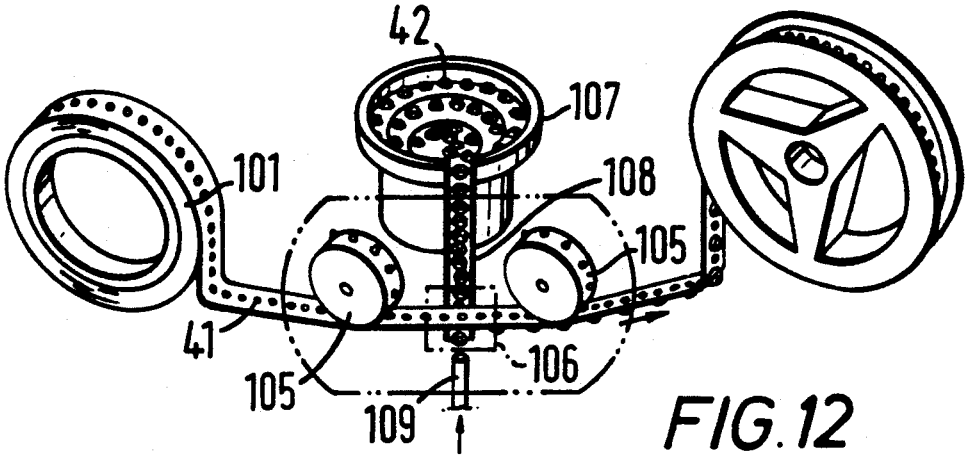
FIG. 12 is a diagram of the application of the transferable articles to the tape formed in FIG. 8.

The manufacture of the tape and the method of applying the transferable articles will now be described with reference to FIGS. 11, 12 and 13 of the accompanying drawings.

A roll of tape 100 having an adhesive layer on one side thereof in the manner described above is unrolled and passed to a take-up spool 101. Perforation head 102 having a pair of spaced punches 103 is arranged to reciprocate against the tape on anvil base 104 to provide a line of perforations 68 in tape 41.

The perforated tape on take-up spool 101 is then passed via control sprockets 105 past a mounting station 106. The mounting station comprises a bin 107 containing a plurality of transferable articles 42 and sorting means comprising a supply tube 108 which orients the articles 42 and supplies them to a position below the tape 41 with the adhesive side 80 of the article 42 directed upwardly towards the adhesive side of tape 41. It will be appreciated that the orientation of the articles is dependant on whether they are to be applied to an intermediate transfer sheet or for direct application to a textile substrate. A reciprocating rod 109 then moves upwardly to engage the exposed surface 78 of article 42 and urge it into adhesive contact with the adhesive side of tape 41 such that the axis of article 42 is substantially coaxial with a perforation in the tape.

Figure 13:
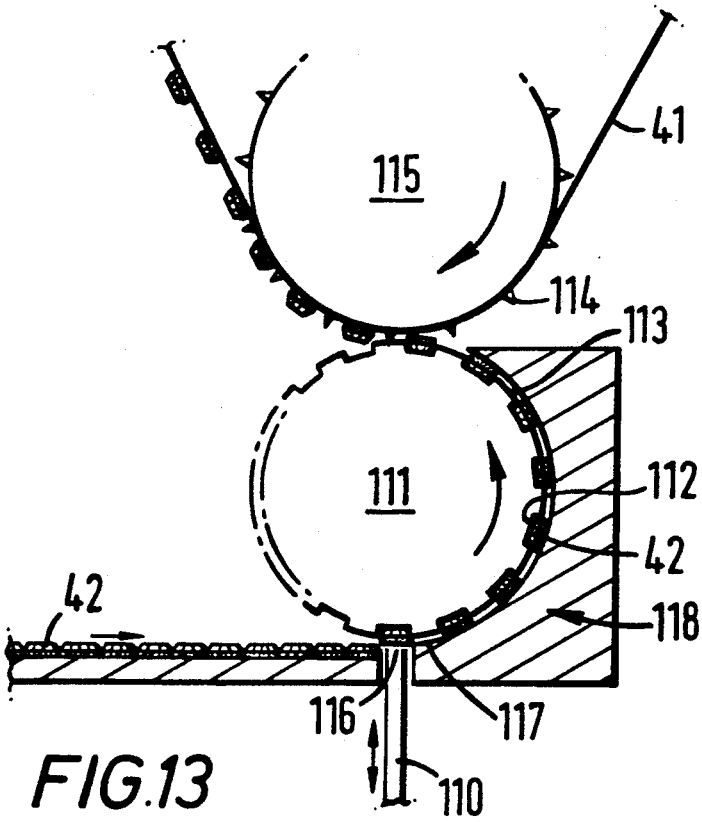
FIG. 13 is an alternative method of the application to FIG. 12.

In an alternative embodiment as shown in FIG. 13 a row of articles 42 is fed sequentially to a reciprocating rod or member 110. A roll 111 is provided with a plurality of shaped recesses 112 circumferentially spaced about the periphery thereof, each recess 112 being adapted to receive and article 42 only in its correct orientation. Surface portions 113 between adjacent recesses 112 are each provided with a recess adapted to accommodate a sprocket tine 114 of sprocket wheel 115. Sprocket wheel 115 is mounted for rotation in engagement with roll 111 with the tines 114 engaging with the recesses in the peripheral portion 113 of roll 111. The perforated tape 41 is engaged with the tines 114 as shown in FIG. 13 so that a sprocket peg 114 engages every other perforation. Incremental rotation of roll 111 will bring a vacant recess 112 juxtaposed with reciprocating member 110. The row of articles 42 is then advanced until an article is placed on the end of reciprocating member 110. The reciprocatable member 110 is then raised until the extremity thereof 116 forms a continuum with the partially cylindrical surface 117 of housing member 118. Continued rotation of roll 111 causes engagement between the walls of the recess 112 with the article 42 supported on the end 116 of rod 110 and serves to slide the article from the end of the rod 110 so that the adhesive layer thereof engages with the surface 117 of housing 118. Continued rotation will bring the article sequentially to a position where the recess 112 is disposed between a pair of spaced tines 114 on sprocket wheel 115. The pressure of engagement between roll 111 and sprocket wheel 115 is such as to urge the article 42 accommodated within cooperating recess 112 into adhesive contact with the adhesive layer on tape 41 to effect adhesion thereto so that continued rotation of the roll 111 and sprocket wheel 115 engaged therewith results in the article 42 adhering to tape 41 being withdrawn from its corresponding recess to be retained on tape 41 for subsequent use or for winding on a reel 39 and to form a roll of decorative articles for use in the machine described above.

In the particular embodiment of the invention described above it is clearly desirable that there should be an acceptable registration between the pin 60 on the transfer head of the machine, the perforation in tape 41 and the transferable article 42. If there is misalignment either of the pin 60 with the perforation, or of the decorative article with the perforation, or both, then the result will be that on the application of downward movement to pin 60 the decorative article 42, if a solid or rigid article such as a rhinestone, will tend to fly out of the machine.

Figure 24:
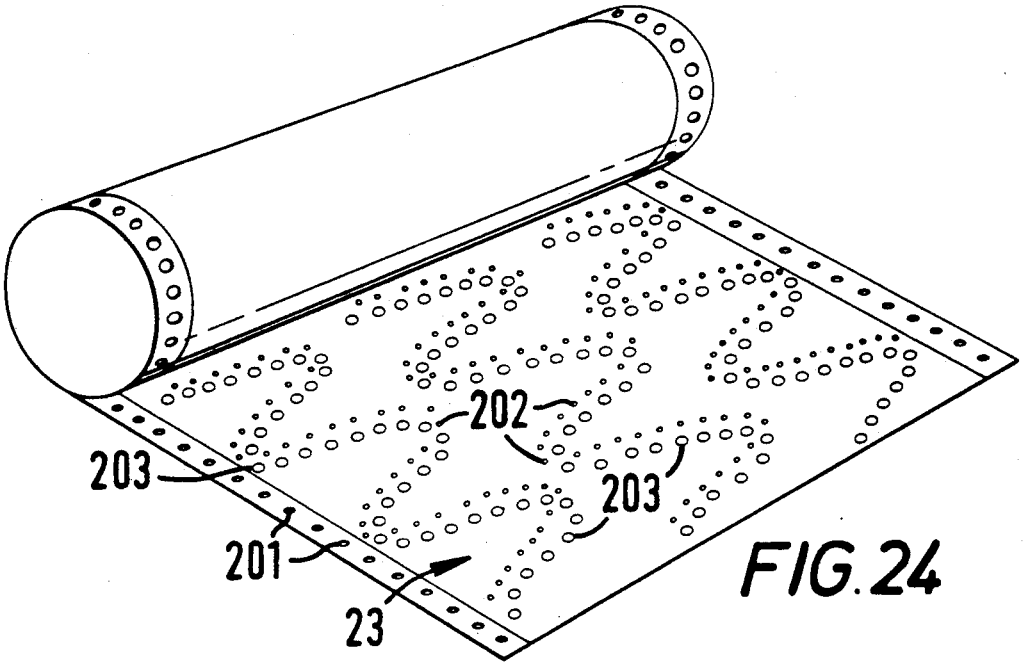
FIG. 24 is a perspective view of an intermediate carrier sheet having a pattern based on two different articles.

Turning now to FIG. 24, the carrier sheet 23 has a row of perforations 201 along each longitudinal edge thereof. These perforations 201 are adapted to engage with the tines provided on rollers 21 and 22 respectively so as to produce exact registration of sheet 23 with anvil surface 34 and pusher element 56 (see FIG. 2) which together constitute a decorating head for the apparatus.

In this particular embodiment, a first series of decorations 202 have been applied initially and a second series of decorations 203 of a type different from the first series of decorations 202 has been applied during a second passage of carrier sheet 23 through the machine, with different tapes 41 carrying the different types of decorative elements.

Alternatively, the article of FIG. 24 can be produced by the use of dissimilar tapes of articles provided on respective decorating heads and by effecting lateral movement of the head and crossbeam assembly in the X-axis to align the decorating heads to produce the pattern of two dissimilar decorations in one pass of sheet 23.

Figure 25:
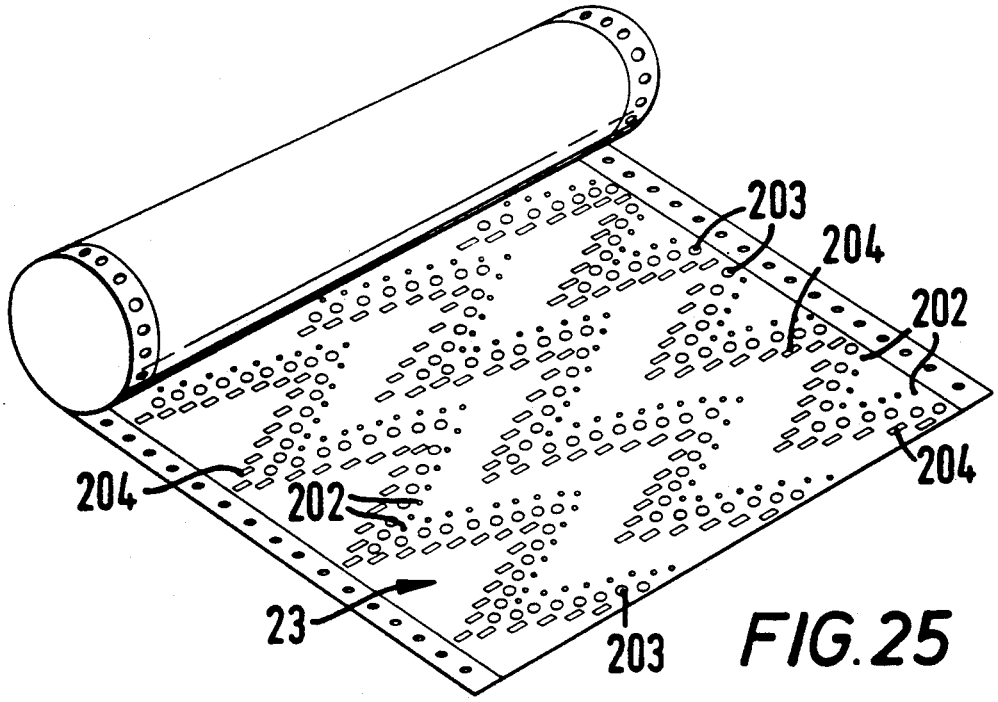
FIG. 25 is a perspective view of an intermediate carrier sheet having a pattern formed of a multiplicity of different decorative articles.

FIG. 25 illustrates a pattern which has been formed by two or possibly three successive passes of sheet material 23 through the apparatus in accordance with the invention. Dissimilar articles 202, 203, and 204 respectively, have been applied to the transfer sheet at each pass.

Figure 26:
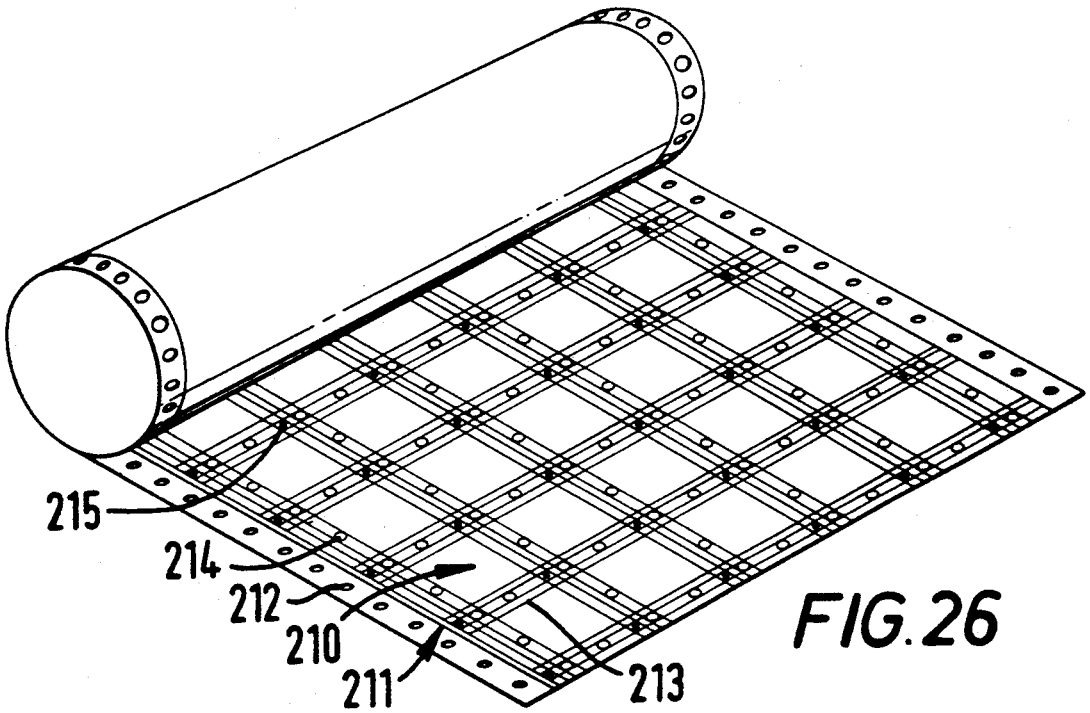
FIG. 26 is a perspective view of another embodiment of a decorated textile material in which articles have been applied in register with an existing pattern thereon.

FIG. 26 illustrates a further embodiment of the present invention in which a textile sheet material 210 is carried on a support sheet 211 having perforations 212 along each longitudinal edge thereof for registration of the sheet with the anvil and press pin constituting the transfer heads of the machine described and illustrated in FIGS. 1 to 6.

In this case, the material 210 has a printed or woven pattern 213 and it is required to apply different types of decorative articles 214 and 215 in a predetermined pattern in relation thereto as shown in FIG. 26.

In this case, the perforations 212 ensure registration of the transfer head with the pattern at the appropriate location for transfer of the articles directly to the sheet material 210. In this case the anvil assembly will need to provide heat and pressure in order to activate the pressure sensitive adhesive on each of the decorative articles.

After application of the decorative articles 214, 215, the textile sheet 210 is separated from its backing sheet 211. A contact adhesive may be used on the surface of backing sheet 211 sufficient to ensure adhesion between the two sheets during the application of the decorative articles 214, 215, but at the same time to allow subsequent ease of separation.

Figure 14:
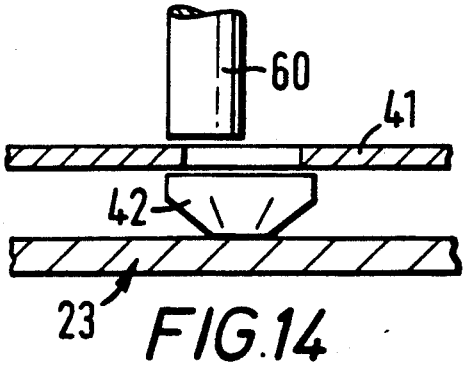
FIGS. 14, 15, 16 and 17 illustrations showing the importance of the registration of the reciprocating transfer member with the perforation in the tape and also the registration of the transferable article with the perforation in the tape.
Figure 15:
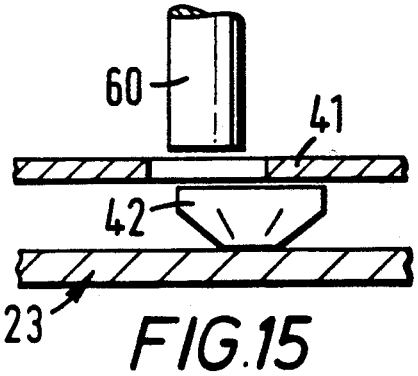
Figure 16:
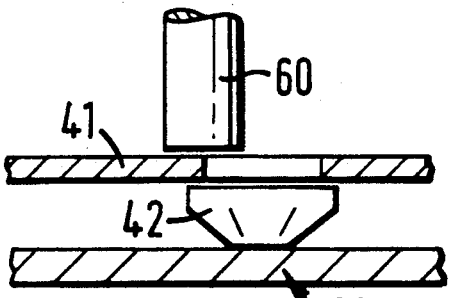
Figure 17:
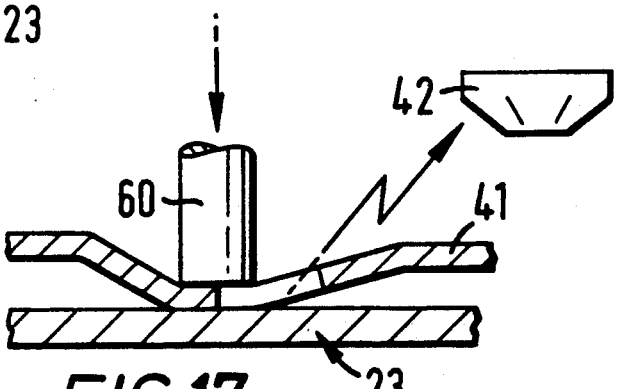
Figure 27:
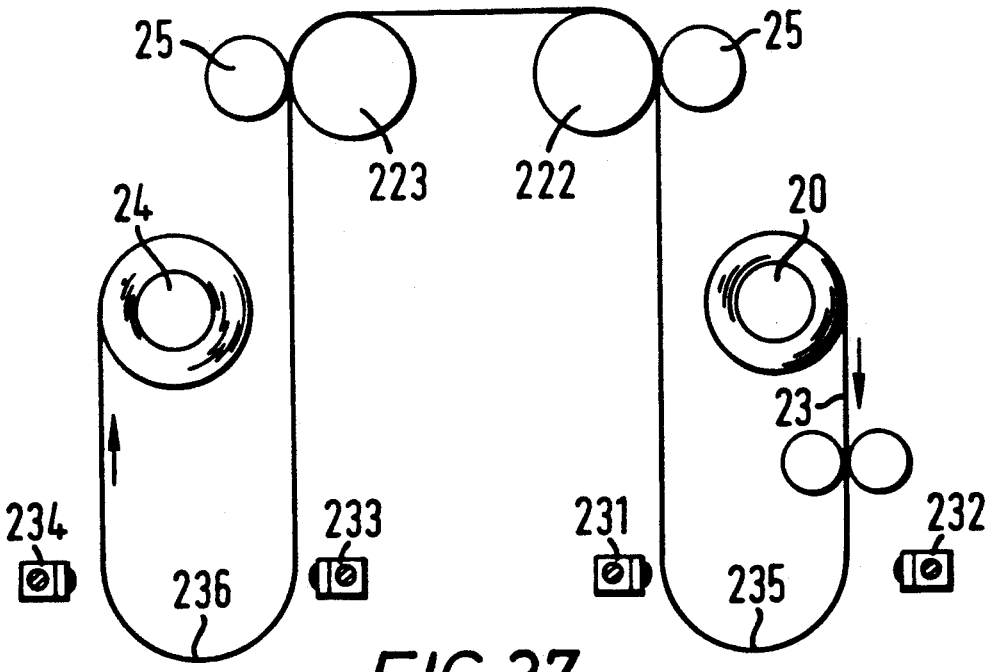
FIG. 27 is a diagram of a modification of the apparatus of FIGS. 1 to 6 to produce the material of FIG. 26.
Figure 28:
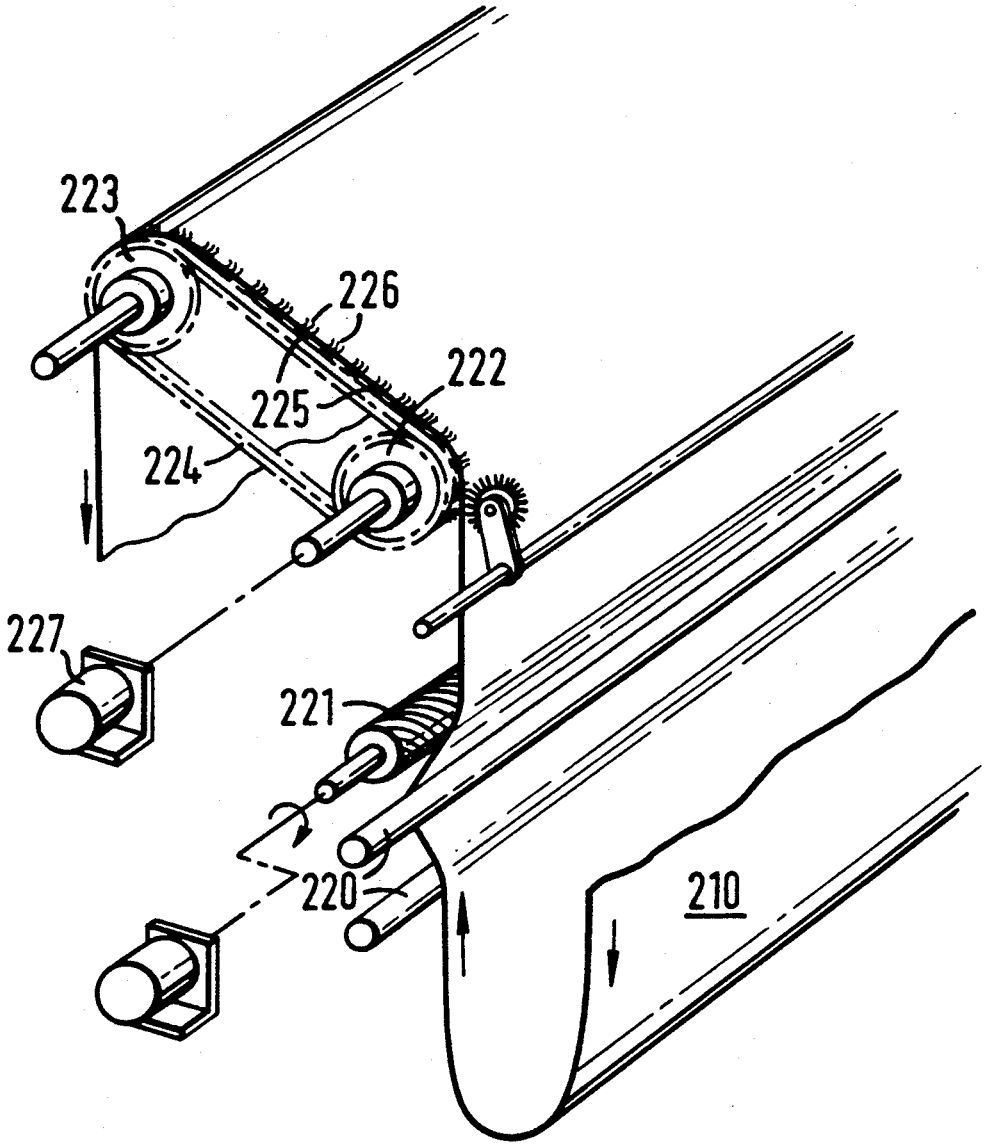
FIG. 28 shows a modification of the apparatus of FIGS. 1 to 6 for the direct application of articles to a textile fabric substrate.

FIGS. 27 and 28 illustrate an alternative method of applying decorative articles directly to a previously decorated or indeed an undecorated textile sheet 210 (see FIG. 28). In this case, sheet 210 is fed between a pair of guide bars 220 and to a contra-rotating roller 221 to provide a degree of stress to the fabric material 210. The rolls 21 and 22 of the apparatus described with respect to FIG. 2 are replaced by sprockets 222 and 223 respectively which are coupled by means of an endless chain 224 on each side having grip means 225 of the type well known to produce a centering effect on the material 210 as it passes thereover. The movement of the material 210 while gripped at its edge 226 is controlled by means of motor 227 which in this instance controls the Y-axis movement of the material. The arrangement described with respect of FIG. 16 obviates the need for the use of the backing sheet 211 as described with respect to FIG. 14 above.

Where the material 210 already has a pattern applied to or woven into it, it will be appreciated that the means for registration of the pattern on the material with respect to the transfer head assembly of the apparatus of FIGS. 1 to 9 will need to be provided. This arrangement is shown in FIG. 27 where two pairs of photoelectric switches are provided. In this case the supply roll 20 is caused to provide a depending loop 235 of material which passes each of control switches 231, 232 and the take-up roll 24 is arranged to provide a similar depending loop 236. The switches 231, 232 are arranged to sense the pattern already provided on textile sheet material 23 and correspondingly serve to control the movement of rolls 223 and 222 respectively by means of motor 227 (see FIG. 28).

Figure 18:
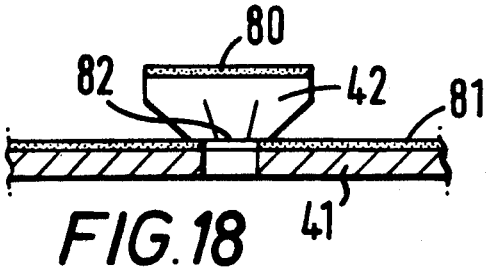
FIGS. 18, 19 and 20 show the orientation of the articles on the tape for direct application to a receptor sheet material.
Figure 19:
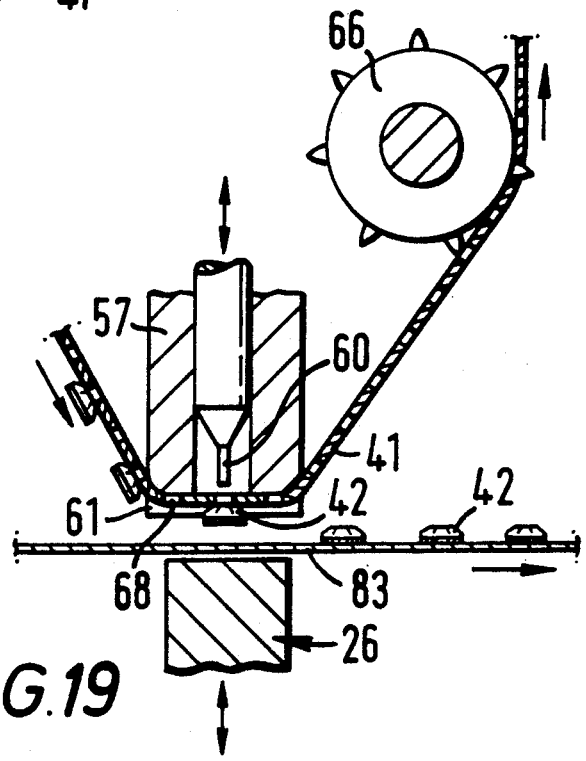
Figure 20:
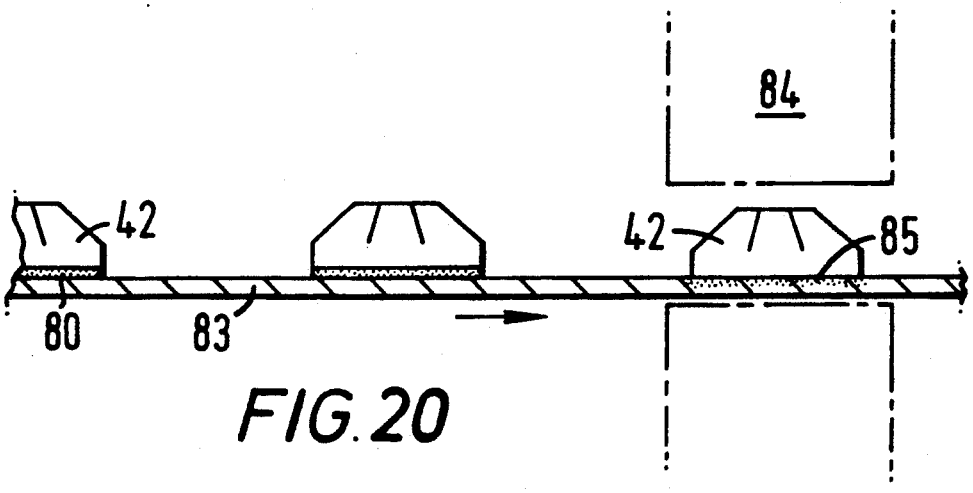

It will be appreciated from the foregoing that there are disclosed two ways in which the invention may be practiced. The first is the application of the article 42 to the tape and then the direct application of the article to the receptor material to be decorated. This sequence of events is clearly shown in FIGS. 18, 19 and 20 of the accompanying drawings. In FIG. 18, the article 42 is a rhinestone which has a heat sensitive adhesive layer 80 thereon. The tape 41 is a tape of a material such as that manufactured by the 3M Company having a layer of tack sensitive adhesive 81 on the surface thereof. The rhinestone 42 is mounted so that the surface 82 which will in the finished article be the upper or decorative surface, is in contact with the tack adhesive layer 81 of 3M's tape 41 as shown in FIG. 18.

In operation at the transfer head of the machine of the invention, the transfer member or push pin 60 enters the perforation 68 to expel article 42 from the tape and into adhesive engagement with the receptor sheet 83 to be decorated. The anvil element 33 of the anvil assembly 26, which is heated, moves upwardly towards pin 60, the arrangement being such that the amount of heat generated by the anvil element 33 and the amount of pressure applied is such as to produce sufficient adhesion between the adhesive layer 80 on the rhinestone 42 and the receptor sheet 83 to be decorated to retain the former thereon. The receptor sheet 83 is then passed through a press 84 whereby heat and pressure is applied sufficient to melt the adhesive layer 80 and to cause it to flow into the interstices of the receptor sheet 83 to provide a firm bonding of the rhinestone 42 thereto by means of the adhesive layer being dispersed into the receptor sheet 83.

Figure 21:
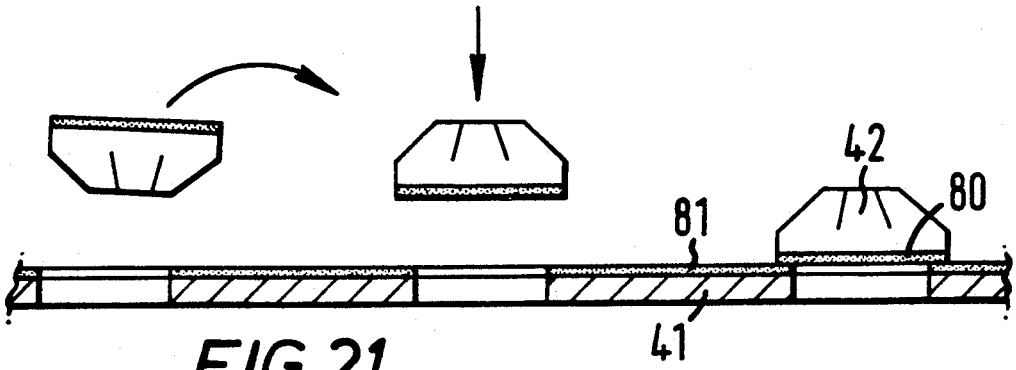
FIGS. 21, 22 and 23 show the orientation of the articles on the tape for application to an intermediate substrate for subsequent transfer to a receptor sheet material.
Figure 22:
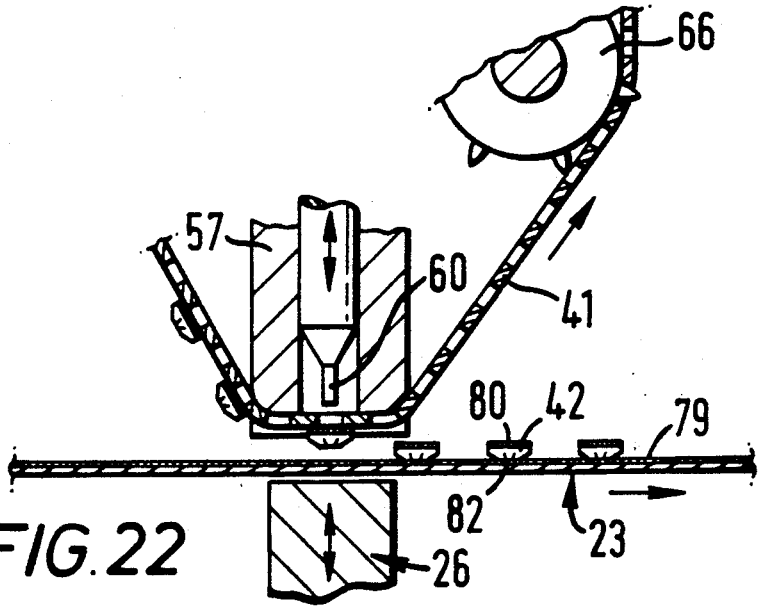
Figure 23:
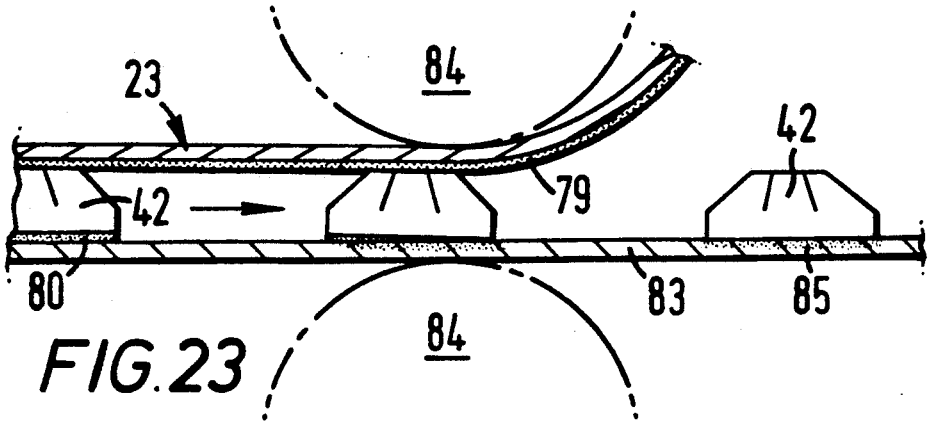

The alternative method is illustrated in FIGS. 21, 22 and 23 of the accompanying drawings. In this case the article 42 is applied to an intermediate substrate or carrier sheet 23. In this case, the rhinestone 42 is located on the tape 41 with its layer of heat sensitive adhesive 80 in contact with the tack adhesive layer 81 of the tape. In other words, in this instance, there is adhesive to adhesive contact but the adhesive action being between the surface of the heat sensitive adhesive 80 and the tack adhesive layer 81 carried on the tape as shown in FIG. 21. In this case, transfer to an intermediate carrier sheet 23 is provided as shown in FIG. 22 where the rhinestones 42 are deposited with their decorative surface 82 in contact with the adhesive layer 79 on carrier sheet 23 so that the layer of heat sensitive adhesive 80 on article 42 is disposed on the surface of the article away from the body of the carrier sheet 23. In this latter case, heating of the anvil is unnecessary.

Referring now to FIG. 23, the decorated carrier sheet 22 now carries the patterns which are subsequently to be transferred to a receptor sheet 83. To effect the further transfer, the carrier sheet 23 and the receptor sheet 83 are brought together so that the adhesive layer 80 of articles 42 are in contact with sheet 83. Heat and pressure is then applied to melt the adhesive layer 80 and cause it to merge into and fuse with the material of receptor sheet 83 thereby producing a permanent bonding of the article 42 to the final decorated receptor sheet 83. This is shown diagrammatically in FIG. 23; although a roller press is illustrated, a platen press may also be employed.

It will be appreciated by one skilled in the art that the use of the machine in accordance with the present invention permits initially the formation of a continuous tape carrying decorative articles of similar or dissimilar type and that the use of that tape in the machine of the invention permits an almost infinite number of patterns to be formed either on a carrier sheet, or on an intermediate carrier sheet for subsequent transfer to a textile sheet material to be decorated, or directly to a textile sheet material. In particular, the machine of the present invention also provides in one aspect means whereby decorative articles may be applied to an already patterned textile sheet material in a systematic and reproducible manner, thus overcoming major disadvantages inherent in the prior art.

I claim:

1. A transfer apparatus for forming a pattern of articles on a substrate having a length and a width, said apparatus comprising:

means for advancing a longitudinal length of substrate material along a substrate path, a transfer station comprising a plurality of transfer heads extending transversely with respect to said path, each transfer head being movable to any position in the transverse direction within the width of the substrate, each transfer head being adapted to transfer articles directly to said substrate, magazine means associated with and movable with each said transfer head to sequentially supply said articles directly from said tape to said substrate, each said magazine means including a perforated tape carrying a plurality of said articles thereon at a predetermined spacing, each adhesively affixed at a perforation, for transfer directly from said tape to said substrate; and control means for controlling the supply of articles from said magazine means, longitudinal movement of the substrate, and transverse movement of the transfer heads, thereby to control relative movement between the substrate and the transfer heads at the point at which each article is transferred from the respective tape to the substrate, said articles being transferred by pressure applied by pressing means at or about each successive perforation.

2. A transfer apparatus as set forth in claim 1, wherein said tape has an adhesive layer on at least one side thereof and each of said articles is releasably secured thereto for sequential presentation to said transfer head.

3. A transfer apparatus as set forth in claim 2, wherein each said transfer head comprises tape guide means for guiding said tape, a reciprocating member adapted to engage said tape, and means to align an article on said tape with said reciprocating member, wherein in operation, the reciprocating member is caused to engage at least one of the tape and the article thereon and urge said article into adhesive contact with said substrate.

4. A transfer apparatus as set forth in claim 1, wherein the tape is a self-supporting perforated tape having an adhesive layer on one side thereof and a plurality of transferable articles adhering to said adhesive layer, each article being in registration with a perforation in the tape.

5. A transfer apparatus as set forth in claim 1, wherein each said transfer head comprises tape guide means for guiding said tape, a reciprocating member adapted to engage said tape, and means to align an article on said tape with said reciprocating member, wherein in operation, the reciprocating member is caused to engage at least one of the tape and the article thereon and urge said article into adhesive contact with said substrate.

6. A transfer apparatus as set forth in claim 5, wherein the tape is perforated and each said transfer head comprises sprocket means adapted to engage perforations in the tape to advance the tape to bring a perforation covered by an article into registration with the reciprocating member, and wherein on operation of said reciprocating member, said member enters the perforation and contacts the article to urge the article into adhesive contact with a substrate while simultaneously releasing the article from said tape.

7. Apparatus as claimed in claim 6, wherein the tape comprises a single line of approximately medial perforations, and wherein the sprocket means is adapted to engage with alternate perforations; said articles being located in the remaining alternate perforations.

8. A transfer apparatus as set forth in claim 6, wherein the transfer head includes anvil means adjacent the substrate sheet path and aligned with said reciprocating member, wherein operation of said reciprocating member brings said article into adhesive engagement with said substrate by pressure against said anvil means.

9. A transfer apparatus as set forth in claim 8, wherein the anvil means includes an anvil member which is movable between a pressure position and a free position, wherein in the pressure position, the anvil member supports the substrate sheet to allow the reciprocating member to press the article into the adhesive layer of the substrate against the back pressure of said anvil member.

10. A transfer apparatus as in claim 8, wherein one of said reciprocating member and said anvil means is vibrated while said reciprocating member brings said article into adhesive engagement with said substrate by pressure against said anvil means.

11. A transfer apparatus as set forth in claim 8, wherein the substrate is the receptor sheet material and the anvil member is heated.

12. A transfer apparatus as set forth in claim 11, wherein the articles are disposed on said tape with the adhesive layer of said articles disposed on the side of each article away from said tape for contact with said receptor sheet.

13. A transfer apparatus as set forth in claim 1, wherein the substrate material is an intermediate carrier sheet having an adhesive layer on a surface thereof adjacent said tape as it passes the transfer station, and wherein each article is disposed on said tape with the adhesive layer thereon in minimal adhesion with the adhesive layer of the tape surface, and the articles are transferred to the intermediate transfer sheet such that each article is oriented with its adhesive layer away from the receiving surface of the intermediate carrier sheet.

14. A transfer apparatus as in claim 1, wherein said control means is programmable for selectively controlling the supply of articles, the longitudinal movement of the substrate, and transverse movement of the transfer heads.

15. Apparatus as claimed in claim 1, wherein the articles are disposed on said tape with an adhesive layer disposed on said articles, on the side of each article remote from the tape, for contact with a substrate material.

16. A transfer apparatus for forming a pattern of articles on a substrate having a length and a width, said apparatus comprising:

means for advancing a longitudinal length of substrate material along a substrate path, a transfer station comprising a plurality of transfer heads extending transversely with respect to said path, each transfer head being movable to any position in the transverse direction within the width of the substrate, each transfer head being adapted to transfer articles directly to said substrate, magazine means associated with and movable with each said transfer head to sequentially supply said articles directly from said tape to said substrate, each said magazine means including a perforated tape carrying a plurality of said articles thereon at a predetermined spacing, each adhesively affixed at a perforation, for transfer directly from said tape to said substrate; and control means for controlling the supply of articles from said magazine means, longitudinal movement of the substrate, and transverse movement of the transfer heads, thereby to control relative movement between the substrate and the transfer heads at the point at which each article is transferred from said respective tape to the substrate, said articles being transferred by pressure applied by pressing means at or about each successive perforation;

wherein each said transfer head comprises sprocket means adapted to engage said perforations in the tape to advance the tape to bring a perforation covered by an article to register with a reciprocatable member forming part of the pressing means, and wherein on operation of said reciprocatable member, said member enters the perforation and contacts the article to urge the article into adhesive contact with the substrate while simultaneously releasing the article from said tape.

17. Apparatus according to claim 16, wherein the tape comprises a single line of approximately median perforations, and wherein the sprocket means is adapted to engage with each alternate perforation; the articles being located in each other alternate perforation.

* * * * *